US006758469B2

(12) United States Patent
Müller

(10) Patent No.: US 6,758,469 B2
(45) Date of Patent: Jul. 6, 2004

(54) GRIPPING CONVEYOR WITH PNEUMATIC SEPARATOR

(75) Inventor: Hans Müller, Zofingen (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/947,928

(22) Filed: Sep. 7, 2001

(65) Prior Publication Data

US 2002/0060391 A1 May 23, 2002

(30) Foreign Application Priority Data

Sep. 11, 2000 (EP) ..... 00810816

(51) Int. Cl.[7] ..... B65H 5/08; B65H 3/08

(52) U.S. Cl. ..... 271/100; 271/93; 271/107; 271/277

(58) Field of Search ..... 271/11, 100, 107, 271/277, 93

(56) References Cited

U.S. PATENT DOCUMENTS

| | | | | | |
|---|---|---|---|---|---|
| 3,767,185 | A | * | 10/1973 | Newsome | 271/11 |
| 4,358,100 | A | * | 11/1982 | Muller | 271/11 |
| 4,405,122 | A | * | 9/1983 | Faltin | 271/10.09 |
| 4,491,311 | A | * | 1/1985 | Glanzmann | 270/54 |
| 5,100,116 | A | | 3/1992 | Graushar | |
| 5,174,559 | A | * | 12/1992 | Diamantides | 271/12 |
| 5,330,169 | A | * | 7/1994 | Hawkes | 271/101 |
| 5,447,302 | A | * | 9/1995 | Curley | 271/277 |
| 5,586,756 | A | * | 12/1996 | Chang | 271/11 |
| 5,833,229 | A | * | 11/1998 | Prim | 271/11 |
| 5,979,889 | A | * | 11/1999 | Klopfenstein | 271/11 |
| 6,070,866 | A | * | 6/2000 | Wepfer | 271/10.11 |

FOREIGN PATENT DOCUMENTS

| | | |
|---|---|---|
| CH | 646 924 | 12/1984 |
| EP | 0 776 771 | 6/1997 |
| EP | 0 824 084 | 2/1998 |
| GB | 1 363 860 | 8/1974 |

* cited by examiner

*Primary Examiner*—Donald P. Walsh
*Assistant Examiner*—Daniel Schlak
(74) *Attorney, Agent, or Firm*—Venable LLP; Robert Kinberg; Jung H. Kim

(57) ABSTRACT

A feeding device for feeding a processing line with printed products, including folded or non-folded printed sheets, from a stack of printed products. The printed sheets are held in a magazine. A conveyor defines a circulating path and moves in a conveying direction for conveying the printed products to the processing line. A synchronously driven separating mechanism, which is pivotally attached to the magazine, acts upon a closed fold or an edge of the printed product and operates to partially remove the printed product from the stack of printed products. A gripping arrangement includes a controlled gripping device attached to the conveyor in a feeding region of the processing line and essentially moves along in the conveying direction for taking over the printed product from the separating mechanism by gripping a front edge of the printed product relative to the conveying direction. The gripping arrangement and the separating mechanism are arranged to one side of the conveyor in an axial direction of the conveyor and arranged adjacent the folds of the printed products so that the respective printed products are gripped only on the one side of the conveyor.

12 Claims, 1 Drawing Sheet

GRIPPING CONVEYOR WITH PNEUMATIC SEPARATOR

CROSS-REFERENCE TO RELATED APPLICATION

This application claims the priority of European Patent Application No. 00810816.9 filed Sep. 11, 2000, the disclosure of which is incorporated herein by reference.

BACKGROUND OF THE INVENTION

The invention relates to a device for feeding printed products, e.g. folded or non-folded printed sheets, to a processing line. Such a device consists of a conveying means for a feeder, designed to remove stacked printed products individually from a neighboring magazine. A printed product is partially lifted off a stack and placed along a circular conveying path by a synchronously driven separating means acting upon a front side edge of the printed product in conveying direction. The conveying means is provided with a gripping arrangement with opening and closing control which takes over the printed product from the separating means by gripping it along the front edge in the conveying direction.

A device of this type, also called a printed-sheet feeder, is disclosed among other things in European patent document EP-A1-0 824 084 and can be inserted into a gathering machine for an adhesive binder, e.g. as disclosed in Swiss patent document Printed sheet feeders of the aforementioned type are also used for so-called gathering and wire stitching machines, where the printed products are gathered straddling, one above the other, along a saddle-shaped gathering and processing line. With these machines, an opening device is installed downstream of the conveying means, which spreads open the printed products along the open edge. In the process, a saddle-shaped processing line is fed by respectively deflecting the printed products by 90°. With the gathering machine as well as the wire stitching and gathering machine, partial operations of this type require additional time, thus reducing the reliability of the processing mode.

The above-mentioned disadvantage is to be corrected primarily by avoiding a deflection of the printed products.

SUMMARY OF THE INVENTION

It is an object of the invention to correct the above noted disadvantage.

This is achieved by replacing the gripping arrangement mounted on the conveying means in the feeding region of the processing line and moving essentially in the same conveying direction, with a controlled gripping device that is arranged directly adjacent to the separating mechanism acting upon the front edge of the conveyed printed product relative to the conveying direction.

This can relate to a partially or completely open edge of the printed product, which forms the front edge in the conveying direction.

A simplified gripping arrangement can be obtained in this way and an additional auxiliary separating element, which is effective crosswise to the conveying direction, can be dispensed with, such as the ones used on gathering machines (Sheridan Rotary Gatherer) of the Sheridan Company in the United States.

According to one embodiment of the invention there is provided a feeding device for feeding a processing line with printed products, including folded or non-folded printed sheets, from a stack of printed products, said feeding device comprising: a conveying means defining a circulating path and moving in a conveying direction for conveying the printed products to the processing line; a synchronously driven separating mechanism for acting upon a closed fold or an edge of the printed product and operating to partially remove the printed product from the stack of printed products; and a gripping arrangement comprising a controlled gripping device attached to the conveying means in a feeding region of the processing line and essentially moving along in the conveying direction for taking over the printed product from the separating mechanism by gripping a front edge of the printed product relative to the conveying direction, wherein the gripping device is arranged directly adjacent to the separating mechanism, and the stack of printed products is arranged so that the fold or edge of the printed product is laterally closed in the conveying direction.

BRIEF DESCRIPTION OF THE DRAWINGS

The invention is explained in the following with the aid of an exemplary embodiment and by referring to the drawing, to which reference is made with respect to all details not expressly mentioned in the description. Shown in the drawing are.

DETAILED DESCRIPTION OF THE INVENTION

Figure 2:
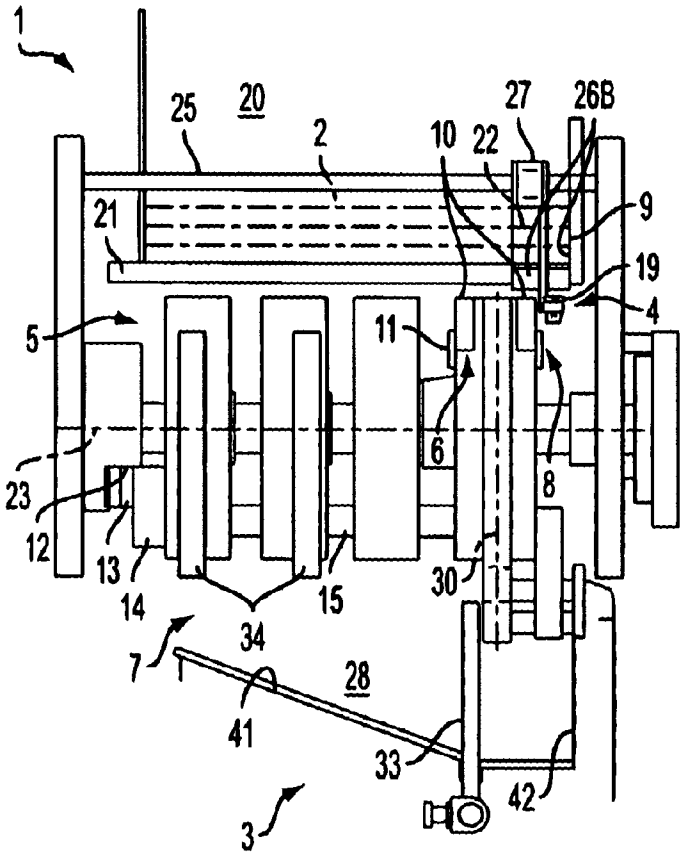
FIG. 2 A view from the side of the device mounted on a gathering machine and shown in FIG. 1.
Figure 1:
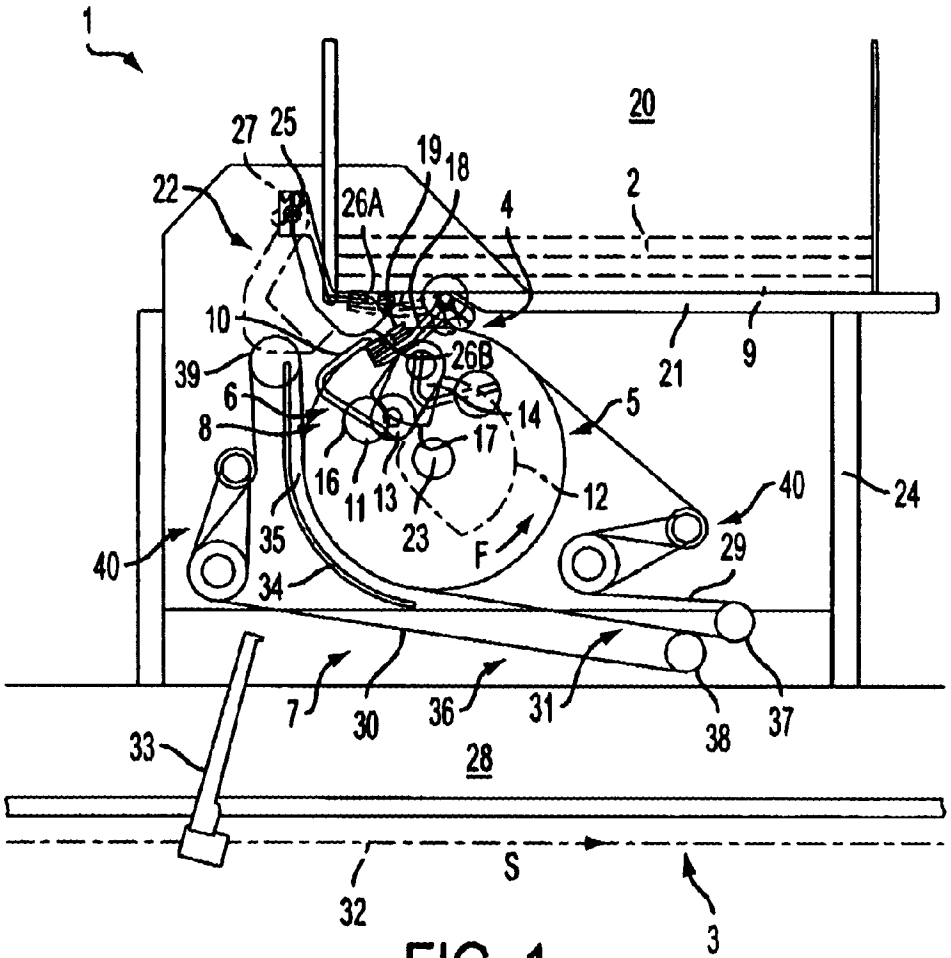
FIG. 1 A front view of a schematic representation of a device according to the invention, mounted on a gathering machine.

FIGS. 1 and 2 show a device 1 for separating stacked printed products 2 and for feeding a processing line 3 with the printed products 2. The printed products 2 are folded printed sheets or, in some cases, non-folded or flat printed pages, which are transferred from a stack in a magazine 20 to a processing line 3 for producing books, brochures, magazines or the like. While the invention has particular applicability to folded printed products, non-folded printed products are not excluded from being processed with the device 1 according to the invention.

A separating mechanism 4 grips the lowest printed product 2 of the stack on the side, along the front end or in a corner region, and feeds the product to a conveying means 5 moving in the direction F. The removal of the printed products from the underside of the stack thus requires a special arrangement of the printed products 2 with respect to the inserted separating mechanism.

To transfer a folded printed product 2 to a processing line 3 without noticeably changing its compact state, for example among the individual pages, the product is gripped, according to the invention, by a gripping device 6 of a gripping arrangement 8, mounted on the conveying means 5 of a feeder 7. For removal, the printed product is gripped immediately adjacent to the (last) fold that is closed on the side, in the conveying direction, and is lifted off the stack by separating means 4. Owing to the closed fold 9, which exerts a stabilizing influence on the printed product 2, the gripping device 6 can grip the printed product 2 without additional help and can clamp it in on one side only of the drum-shaped conveying means 5. The gripping arrangement 8 otherwise can consist of one or several gripping devices 6, distributed over the circumference 1 of conveying means 5. The gripping devices 6 are respectively provided with one or two gripping device arms 10, attached to a gripping device shaft 11, and can be pivoted with these arms into an open or closed position, as shown in FIG. 1. A control face 12 fixedly arranged inside a frame is provided for this purpose. Rollers 13 of a control lever 14, that is connected to a control shaft 15, circulate along face. 12. A toothed segment 17, which is mounted on control shaft 15 and engages with a toothed wheel 16 that is rigidly mounted on the gripping device shaft 11, causes the opening and closing movement of gripping arms 10. Control mechanisms of this type as well as similar ones are known.

The mechanism 4 is a suctioning device connected to a vacuum source, which is provided with one or two (known) suction heads 19 on a pivoting arm 18 that can be activated either individually or together. FIG. 1 shows the position of separating mechanism 4 at the instant of gripping a printed product 2 from the stack underside. The lowest printed product 2 can always be reached through an opening in a bottom plate 21 of magazine 20.

The synchronized operation of separating means 4, conveying means 5 with gripping arrangement 8 and processing line 3 is known and thus can also be controlled for the present device 1.

For the exemplary embodiment shown, the printed products 2 are located in a magazine 20 above the conveying means 5, in which the printed products 2 are stacked one above the other. According to FIG. 2, the closed folds 9, arranged on the right side, are assigned to the separating mechanism 4 or the gripping devices 6. Of course, the present invention permits arranging the folds 9 as well as the separating mechanism 4 and the gripping devices 6 on the opposite side of the magazine 20. The present invention also makes it possible to arrange and process printed products 2 that are stacked in an upright position, as shown in the EP-A1-0 824 084.

A retaining device 22, known per se, prevents an automatic tilting downward of the lowest printed product 2 in the bottom opening. Retaining device 22 acts to support stack 2 projecting from the magazine bottom near the approach region of separating mechanism 4 and gripping device 6. Retaining device 22 is connected with a clamp 27 to a shaft 25, that is parallel to rotating axis 23 of conveying means 5, for pivoting on frame 24 of feeder 7. Retaining device 22 has a supporting surface 26A, which is approximately aligned with the magazine bottom 21 (see FIG. 1) while in the operating position. FIG. 1 shows with dash-dot lines that retaining device 22 is pivoted out of the supporting position to allow separating mechanism 4 to grip the lowest printed product 2. The retaining device is then pivoted back as soon as the printed product 2, gripped by the separating mechanism 4, is moved out of the pivoting range of the retaining device 22. The front of retaining device 22 projects counter to the circulating path of printed products 2 on the conveying means 5, thus functioning as a sliding guide 26B, which is directed toward the lowest printed product 2 during the removal of the printed product.

FIG. 2 illustrates that on the side, the retaining device 22 at least partially projects over the effective range of the one gripping device 6 of gripping arrangement 8, and that an additional gripping device 6, adjacent to the first, is provided, which improves the clamping effect on a printed product 2, thus helping to maintain the positioning of a printed product 2 on the conveying means 5. FIG. 1 also shows the non-operating position of gripping device 6 with dash-dot lines.

A gathering channel 28 that serves as a processing line 3 inside a gathering machine is supplied directly, meaning the feeders 7 that are arranged directly above the gathering channel 28 transfer the printed products 2 from the magazine 20 to the gathering channel 28 without change in direction. Once the gripping arrangement 8, consisting of one or more gripping devices 6 or double gripping devices distributed over the circumference of conveying means 5, has taken over printed product 2 from separating mechanism 4, the conveying means 5 transports the printed product with the aid of a conveying device 36, consisting of rotating belts 29, 30, into the gathering channel 28. For this, the conveying belts 29, 30 after a printed product 2 is gripped with the gripping devices 6, extend at an approximately 90° angle next to each other along the circumference of the conveying means 5. They form a conveying gap for transporting the printed products 2, with a conveying means end section 31 that is pointed downward at a slant and is oriented approximately in the same direction as the conveying direction S of gathering channel 28 and ends in the gathering channel 28. The gathering channel 28 has a support surface 41 that is slanted upward on the side, so that the supplied printed products 2 slide forward into a side channel wall 42, respectively with their closed fold 19 in front. In the gathering channel 28 where the printed products 2 come to rest one above the other, they are respectively gripped at the rear edge by a carrier 33, attached to a circulating traction element 32, and are transported further.

Owing to the fact that the printed products 2 are respectively transported with frictional adherence only in a side region between two conveying belts 29, 30, two stationary guide elements 34 are provided over the width of the conveying means 5, which respectively form a guide gap 35 together with the conveying means 5, so that the printed products 2 are guided over the complete conveying width.

For the conveying belts 29, 30 to form the conveying path along the circumference of conveying means 5 and the following conveying means end section 31, the conveying belt 29 on the one hand circulates around the conveying means 5 and a stationary roller 37 at the end of the conveying arrangement 36. The conveying belt 30, supported by the conveying means 5, which fits against the conveying belt 29 respectively circulates around a roller 38 at the conveying end section, which is located adjacent to the roller 37, as well as an additional stationary deflection roller 39, positioned upstream of the conveying means 5. The conveying belts 29 and 30 are tensioned respectively on the strand located opposite the effectively conveying strand by means of a lever-type tensioning device 40.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A feeding device for feeding a processing line with printed products, including folded printed sheets, from a stack of printed products, said feeding device comprising:

a magazine for holding the folded printed sheets;

a conveying means defining a circulating path around an axis and moving in a conveying direction for conveying the printed products to the processing line with the folds of the printed products extending in the conveying direction;

a synchronously driven separating mechanism pivotally attached to the magazine for acting upon a front edge of a printed product and operating to partially remove the printed product from the stack of printed products; and a gripping arrangement comprising a controlled gripping device attached to the conveying means in a feeding region of the processing line and essentially moving along in the conveying direction for taking over the printed product from the separating mechanism by gripping the front edge of the printed product relative to the conveying direction, wherein both the separating mechanism and the gripping arrangement are arranged to one side of the conveying means in an axial direction of the conveying means and arranged adjacent the folds of the printed products so that the respective printed products are gripped only on the one side of the conveying means.

2. The device according to claim 1, wherein the conveying means is arranged above the processing line and is driven around at least one axis positioned crosswise to the conveying direction of the printed products.

3. The device according to claim 2, wherein the conveying means moves along a circular path.

4. The device according to claim 1, wherein the separating mechanism comprises a suction device connected to a vacuum source and which moves between an underside of the printed product stack and the circulating path of the conveying means.

5. The device according to claim 4, wherein the conveying means is rotatable around a rotational axis, and the suction device is pivotable around an axis extending parallel to the rotational axis of the conveying means and includes at least one suction head on a pivoting end of the suction device.

6. The device according to claim 1, and further including a retaining device having a supporting position for supporting an underside of the printed product stack and being movable away from the underside of the printed product stack, the retaining device having a guide section for guiding the printed product together with the circulating path of the conveying means while the retaining device is in the supporting position.

7. The device according to claim 1, wherein the conveying means is drum-shaped at least in a region of a circulating path for the gripping arrangement.

8. The device according to claim 1, further comprising a conveying arrangement defining a conveying channel nearly across an effective conveying region of the conveying means and arranged downstream of the conveying means.

9. The device according to claim 8, wherein the conveying channel extends into an approach region of the processing line and comprises circulating conveying belts that fit against each other.

10. The device according to claim 9, wherein the conveying arrangement comprises guiding elements arranged in an effective range of the conveying means.

11. The device according to claim 1, wherein the device is arranged above the processing line which is configured as a gathering channel for a gathering machine.

12. The device according to claim 1, wherein both of the separating mechanism and the gripping arrangement are arranged to only one side of the conveying means in an axial direction of the conveying means.

* * * * *